US006397537B2

(12) United States Patent
Auer et al.

(10) Patent No.: US 6,397,537 B2
(45) Date of Patent: Jun. 4, 2002

(54) PARTITION WALL

(75) Inventors: Karl-Heinz Auer, Burk; Nicole Liebrich, Aalen, both of (DE)

(73) Assignee: Perform Holding D.O.O., Ljubljana-polje (SI)

( * ) Notice: Subject to any disclaimer, the term of this patent is extended or adjusted under 35 U.S.C. 154(b) by 0 days.

(21) Appl. No.: 09/815,608

(22) Filed: Mar. 23, 2001

Related U.S. Application Data

(63) Continuation of application No. PCT/EP99/06922, filed on Sep. 18, 1999.

(51) Int. Cl.[7] ..... E04B 1/38

(52) U.S. Cl. ..... 52/282.2; 775/731.5; 403/170

(58) Field of Search ..... 52/282.2, 474, 52/762, 763, 766, 768, 775, 731.5, 239, 36.1, 586.2; 403/170, 171, 175, 176, 174; 160/130, 135, 351

(56) References Cited

U.S. PATENT DOCUMENTS 3,222,839 A * 12/1965 Phlpot ..... 52/768
4,388,786 A * 6/1983 Gassler ..... 52/282
4,493,172 A * 1/1985 Jones ..... 52/220
4,805,365 A * 2/1989 Bastian ..... 52/282
5,291,708 A * 3/1994 Johnson ..... 52/282.2
5,315,805 A * 5/1994 Harsch ..... 52/775
5,791,806 A * 8/1998 Giehl ..... 403/117

* cited by examiner

*Primary Examiner*—Carl D. Friedman
*Assistant Examiner*—Jennifer I. Thissell
(74) *Attorney, Agent, or Firm*—Katten Muchin Zavis Rosenman

(57) ABSTRACT

Partition wall comprising at least one wall element (5) connected to a column (6) by a connecting element (1). The column (6) has a plurality of grooves distributed along its periphery and suitable for interacting with the connecting element (1). The wall element (5) has a connection profile (9) with at least one groove (11) on the edge side bordering on the column. The connecting element (1) has two clamping flanges (2,3) parallel to each other and interconnected by a connecting rod (4), wherein one flange is received in a groove (15) of the column (6) and the other flange is received in a groove (11) of the wall element (5). One (2) of the clamping flanges (2,3) of the connecting element (1) is received in the corresponding groove (11;15) in a rotationally fixed manner while the other clamping flange (13) is received in the corresponding groove (15;11) in such a way that it can rotate around its longitudinal axis (12) within a predetermined angular area.

10 Claims, 9 Drawing Sheets

PARTITION WALL

This application is a continuation of Ser. No. PCT/EP99/06922, filed Sep. 18, 1999.

The present invention concerns a partition wall according to the generic portion of claim 1. It thus particularly concerns a partition wall, comprising at least one wall element connected with a column via a connecting element, with the column having a number of grooves, distributed on locations around its circumference, suitable for interacting with the connecting element.

There is an almost incalculable abundance of different partition walls which can be assembled from premanufactured components (wall elements and columns). The large number of different systems is hereby primarily a consequence of these types of partition walls being intended for use in greatly differing applications. A typical field of application is the subdivision of large area offices into individual zones, whether they are open regions or closed cells, for example conference rooms. These types of partition walls are also used for the shielding of individual workplaces, for example against visibility, sound, and/or the undesired incidence of light. In addition, the use of these types of partition walls in the field of exhibitions and shows is widespread.

For partition walls, great value is placed on a flexible design. This is exhibited particularly in that the wall elements can be attached at various angles to the columns. In order to fulfill this requirement, the connection between wall elements and columns can occur in various ways. Particularly well-known are connections by means of hook-and-loop materials (e.g. CH 632034 A5), by means of magnetic forces (e.g. CH 662601 A5), by means of hooks provided on the wall elements which engage in ring grooves of the columns (e.g. DE 7222826 U1), or by means of mechanical connecting elements (e.g. clamping or locking elements) which are provided on the edges of the wall elements and which engage in longitudinal grooves of the columns (e.g. U.S. Pat. No. 4,544,300, DE 2931026 A1, EP 0118411 A2, EP 0552647 A1).

Furthermore, for the attachment of two wall elements to one another, the use of connecting elements having two clamping flanges, which are parallel to one another and are connected with one another via a connecting link, with one of the flanges accommodated in a groove of an edge profile of each of the linked wall elements, is known. In particular, U.S. Pat. No. 4,232,724 A, U.S. Pat. No. 4,777,777 A, FR 2479306 A1, GB 2051916 A, and WO 95/28532 form a relevant prior art in relation to the latter mentioned type of connection of two wall elements with one another.

According to U.S. Pat. No. 5,531,539 A, which forms the most similar prior art and from which a partition wall according to the generic portion of claim 1 can be derived, every wall element is rigidly connected with the assigned column via a connecting element. The column hereby has four grooves, so that wall elements can be connected to it in four different positions which are orthogonal to one another. Furthermore, the possibility of connecting two wall elements with one another so that they are articulated, in that a specific connecting element includes a film hinge, can be inferred from this document.

A problem of known partition walls is the competition between flexibility and strength in the completely assembled partition wall. To improve the flexibility, i.e. to increase the possible positions of the wall elements and columns relative to one another, the number of grooves in the columns is, according to the prior art, increased. However, beyond a certain number of grooves, this results in a weakening of the ribs which border them.

The present invention is designed, for partition walls of the type according to the generic portion, in which wall elements are connected with columns by the use of connecting elements, to improve the flexibility with regard to design and possibilities of use, without simultaneously reducing the strength of the completely assembled partition wall.

To solve this task according to the present invention, it is provided that one of the two clamping flanges of the connecting element is accommodated in the groove assigned so that the flange can be pivoted around its longitudinal axis within a predetermined angular range.

The present invention thus distinguishes itself in that the connection between wall elements and columns is produced via a connecting element which is connected with both the relevant wall element and the relevant column in an essentially identical way, namely in that a clamping flange of the connecting element is accommodated in a groove of the column or of the wall element, respectively. It is hereby characteristic of the partition wall according to the invention that one of the two clamping flanges of the connecting element is non-rotatably accommodated in the groove (of the wall element or the column, respectively) assigned, while in contrast, the other clamping flange is accommodated in the groove (of the column or the wall element, respectively) assigned so that it can pivot around its longitudinal axis within a predetermined angular range. In other words, the connecting element is rigidly connected with one of the two components (wall element or column, respectively), while, in contrast, it has a flexible connection with the other component (column or wall element, respectively). In this way, a certain asymmetry, which is significant for solving the tasks further stated above, is characteristic of the connection of wall elements and columns used in the course of the present invention. In regard to design and usage possibilities, a degree of flexibility of the partition walls previously unknown for partition walls according to the generic portion results via a continuous adjustability due to the articulated connection of the connecting element with one of the components. The column manages with a relatively small number of grooves, in order to cover all typical angular positions, so that the ribs bordering the grooves can be implemented with relatively thick walls. This, like the non-rotatable connection of the connecting element with the other components, ensures that the strength of the completely assembled partition wall is not diminished.

In the framework of the present invention, the accommodation of a clamping flange in the assigned groove so that it can pivot within a predetermined angular range can be assigned to the edge profile of the wall element; in this case, the connecting element is rigidly connected with the column. However, in the same way, it is also possible that the accommodation of a clamping flange so that it can pivot within a predetermined angular range can be assigned to the assigned groove in the column; in this case, the connecting element is rigidly connected with the wall element. Both of the two alternatives are connected with specific advantages, so that one or the other development is preferable depending on the area of application. If, according to the first alternative, the accommodation of a clamping flange in the assigned groove so that it can pivot within a predetermined angular range is assigned to the edge profile of the wall element, the openings of the grooves in the column can be implemented as particularly narrow. In this case, the column is distinguished by a largely closed surface, which is of equal advantage from both structural and aesthetic viewpoints.

The connecting element used in the course of the present invention can be, but does not have to be, designed as symmetrical. In this sense, the two clamping flanges can preferably have an identical cross-section; however, this is not imperative, as will be described below in more detail. At least one of the two clamping flanges preferably has a cross-section which is at least partially circular. This is practical for ensuring the ability of the clamping flange to pivot around its longitudinal axis, with the arrangement of the clamping flange in the assigned groove having the largest possible area.

Another preferred embodiment of the invention is characterized in that a locking element is provided, by means of which the angular position of the connecting element in the groove in which the assigned clamping flange is pivotably accommodated can be fixed. This type of locking element can have many technical and structural realizations. In particular, it can be provided that at least one of the two clamping flanges is slotted and can be expanded by means of an expanding element. It is particularly preferable if the slotted clamping flange has a cylindrical cavity delimited by two springy cheeks. The slot and/or the cylindrical cavity of the round clamping flange hereby serves for accommodation of an expanding element. With this, the relevant round clamping flange can be expanded. If the clamping flange is expanded, the connecting element is fixed in the relevant groove by frictional resistance. The expanding element can hereby particularly be implemented as a twistable (eccentric) toggle. For practical purposes, two stops are hereby provided which delimit the angular range within which the toggle can be twisted, with one stop defining the position of minimum expansion of the relevant clamping flange and the other stop defining the position of maximum expansion. This is shown to be particularly practical in this background when one considers that, due to the assembly situation of the partition wall, it is frequently not possible to visually check the position of the toggle. Other parts could also be considered as expanding elements, such as wedges or conical thorns, which expand the clamping flange when they are inserted axially into the slotted clamping flange and/or possibly into its cavity.

In a particularly preferred further development of the invention, the connecting element is distinguished by at least one slotted, round clamping flange in that the clearance of the slot is at least as large as the difference between the diameter of the clamping flange and the clearance of the opening of the groove which is provided for the flexible accommodation of the connecting element. With this type of coordination between the round clamping flange of the connecting element on one hand and the groove of the wall element or the column, respectively, on the other hand, the round clamping flange can be compressed to such a degree that it can be inserted into the groove through the lateral opening of the groove. In this way, axial insertion of the round clamping flange of the connecting element in the appropriate groove of the wall element or the column, respectively, can be avoided during assembly of the partition wall. Rather, the relevant components can be laterally clipped onto the round clamping flange of the connecting element, which has its non-round clamping flange inserted in a groove of the other component. This is particularly advantageous in regard to subsequent rearrangement of an already assembled partition wall; because in this way, an existing partition wall can be supplemented as desired with further wall elements without previously having to be disassembled and/or dismantled. Only when the wall element or the column, respectively, has been clipped onto the round clamping flange of the connecting element is the expanding element activated in the round clamping flange to expand it, in order to prevent the wall element and/or the column from being pulled laterally away from the connecting element and, possibly, also to ensure fixing of the angle set between the wall element or the column, respectively, and the connecting element.

The connecting element used in the framework of the present invention can, according to a further preferred embodiment of the invention, have an asymmetrical design of a type such that the two connection flanges have different cross-sections available. In this regard, one of the two clamping flanges has available, for practical purposes, a contour which is at least partially round; this is favorable in regard to the pivotability of this clamping flange—referred to in the following as "round"—in a corresponding groove of a partition wall component (wall element or column), in which this clamping flange is accommodated. The other clamping flange has available, for practical purposes, a contour which is at least partially non-round; this, in turn, is favorable in regard to a non-pivotable, interlocking, non-rotatable accommodation of this clamping flange—referred to in following as "non-round"—in a corresponding groove of the other partition wall component (column or wall element), which is to be connected with the first partition wall component using the asymmetrical connecting element. In this regard, the non-round clamping flange of the connecting element can be accommodated in a groove of the column in an interlocking, non-rotatable way, while the round clamping flange of the connecting element is accommodated, in a groove of a connection profile provided on the edge of the wall element, so that it is pivotable within a predetermined angular range around its longitudinal axis. The interlocking, non-rotatable accommodation of the non-round clamping flange of the connecting element in a groove of the column leads to a clear fixing of the connecting element on the column in a predetermined, defined position. In contrast, the accommodation of the round clamping flange of the connecting element in a groove of the connection profile of the wall element so that it can be pivoted within a predetermined angular range around its longitudinal axis leads to a continuously adjustable positioning of the wall element relative to the column as desired within this angular range. It is significant in this connection that, for adequately fixed connection of a wall element with a column, only one connecting element, possibly consisting of several segments arrayed axially, needs to be provided, which makes the pivotability of the wall element around the axis of the round clamping flange of the connecting element possible.

It is noted here only for clarification that, in this connection, the transition region in which each of the clamping flanges merges into the connecting link should not be viewed as "round" or as "non-round" in the sense of the present terminology; rather, it is not considered in the determination of the cross-sectional form of the clamping flange.

As can be inferred from the subsequent explanations, the previously described asymmetrical design of the connecting element is also favorable insofar as it can, under certain circumstances, also be used for the connection of two identically designed wall elements with one another.

The columns usable in the framework of the present invention preferably have a number of identical grooves which are positioned around the circumference of the column with a separation of 45°. In this case, the predetermined angular range, within which the relevant clamping flange can be pivoted around its longitudinal axis in a groove of the wall element, is particularly preferably ±15°. Each of the basic positions relative to one another (90°, 135°, 180°) of two wall elements attached to the relevant column can, in this case, be enlarged and reduced by a total of 30° at a time through the play of ±15° existing for both wall elements; this means that the two wall elements attached to the column can, in this case, assume any desired angle relative to one another. Specific angular positions (e.g. 120°) can hereby even be achieved in two ways, namely by enlargement of the 90° basic position by two times 15°, and also by reduction of, for example, the 135° basic position by 15°.

Another preferred further development of the invention is characterized in that, on its side toward the column, the wall element has concave curved bearing surfaces on both sides of the at least one groove. The curvature of the bearing surfaces hereby essentially corresponds to the curvature of the surface of the column between two of the grooves. The predetermined angular range within which the wall element can be pivoted around the longitudinal axis of the relevant clamping flange is hereby delimited by fitting of one of the two bearing surfaces to the surface of the column. Damage to the column and/or the wall element is hereby prevented due to the planar bearing.

In the following, the present invention will be described in more detail with reference to the attached drawings. These show:

FIG. 1 a wall element-column connection according to the invention in which the symmetrical connecting elements are flexibly accommodated in the column;

FIG. 2 illustrates a further wall element-column connection according to the invention having a symmetrical connecting element, with the flexible accommodation of the connecting element assigned to the wall elements; and FIG. 3 shows a wall element-column connection in which fixing of the wall elements via a second connecting element, which is also symmetrical, can occur at defined positions of the wall elements relative to the column;

Figure 1:
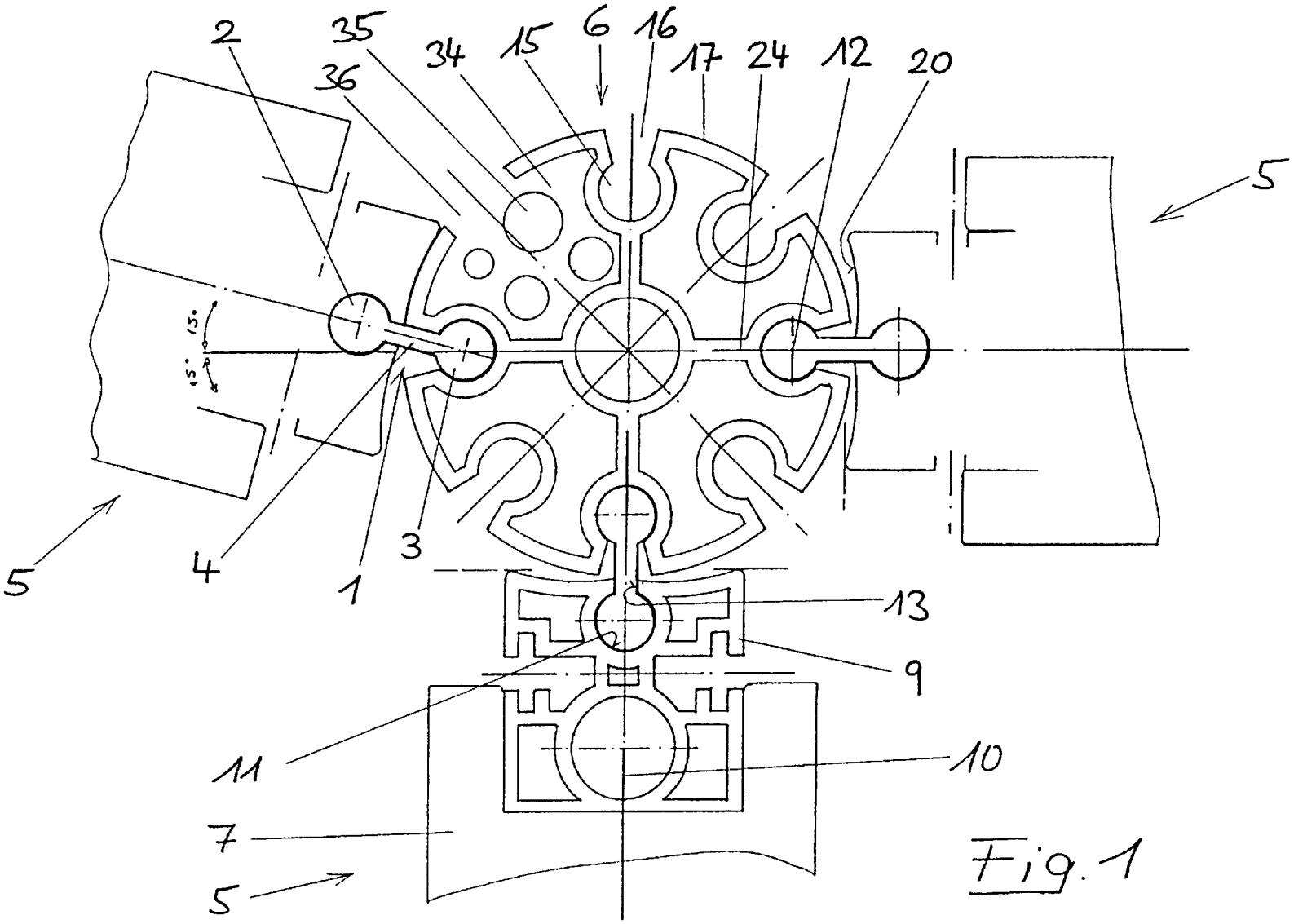

According to FIG. 1, a connecting element 1 is provided for connection of each schematically represented wall element 5 with a column 6. The connecting elements 1 each comprise a first clamping flange 2 and a second clamping flange 3, which are connected with one another via a connecting link 4. The two clamping flanges 2 and 3 hereby have an identical circularly cylindrical cross-section, thereby providing the connecting element 1 with a symmetrical design.

Each of the wall elements 5 comprises a wall body 7 and a connection profile 9 located on its edge. The latter has a groove 11, located in the central plane 10, which is suitable for accommodation of one of the clamping flanges 2 or 3, respectively, of the connecting element 1. The clearance of the opening 13 of the groove 11 is only insignificantly larger than the thickness of the connecting link 4 of the connecting element 1. Due to this, a non-rotatable, interlocking connection of the connecting element 1 with the connection profile 9 of the wall element 5 results.

In contrast, the grooves 15 and the openings 16 of column 6 assigned to them are implemented in such a way that the connecting element 1 can, within a predetermined angular range, be pivoted around the axis 12 of the clamping flange 3 accommodated in the groove 15. This range is 15° on both sides of the center line 24. The specific end position is hereby defined by setting the connecting link 4 of the connecting element 1 against one of the two walls delimiting the opening 16, which diverge from one another. In the end position, one of the concave curved bearing surfaces 20 of the connection profile 9 is simultaneously placed against the convex curved external surface 17 of the column 6.

The individual grooves 15 of the column 6 are positioned around the circumference of the column with a separation of 45°. Due to the pivotability of the connecting element 1 within the grooves 15 by ±15°, two wall elements 5 can be aligned at any desired angle to one another. The column 6 has a total of seven grooves 5 available. In addition, a cable shaft 34 is provided in which electrical lines 35 can be laid and which is externally accessible via an opening 36.

Figure 2:
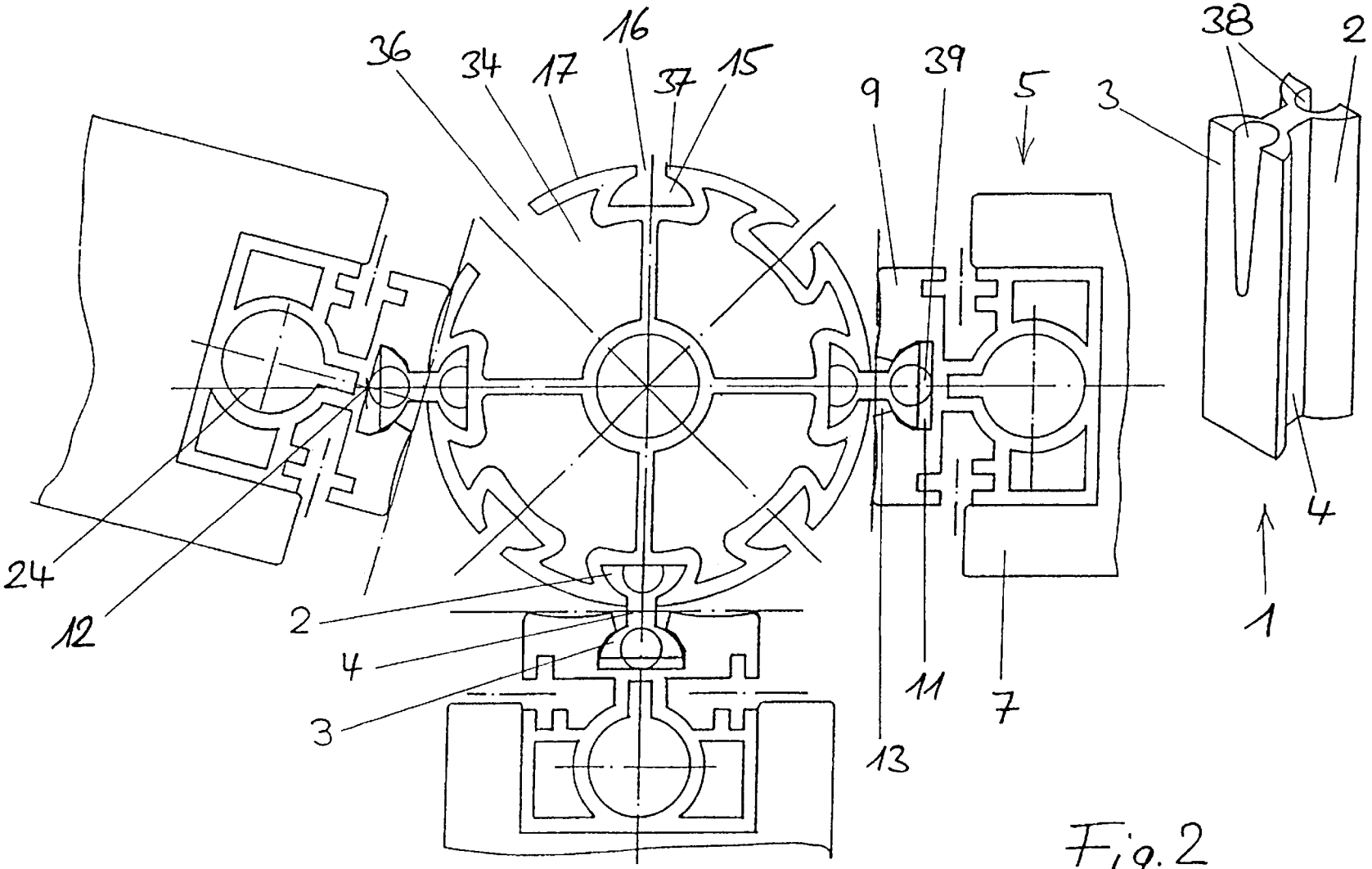

The wall element-column connection illustrated in FIG. 2 primarily differentiates itself from that according to FIG. 1 in that the connecting element 1 is not flexibly connected with the column 6, but rather with the relevant wall element 5. For this purpose, the grooves 15 of the column 6 are shaped in such a way that they accommodate the assigned clamping flange 2 of the connecting element 1 in an interlocking and non-rotatable way. In particular, the clearance between the lips 37 delimiting the openings 16 of the grooves 15 is only slightly larger than the thickness of the connecting link 4 of the connecting element 1. In comparison with the wall element-column connection according to FIG. 1, an extensively closed surface of the column 6 hereby results, which could be desirable from an aesthetic viewpoint.

The embodiments of the grooves 15 of the column provided according to FIG. 1 essentially apply for the design of the grooves 11 of the connection profile 9 of the wall element 5 provided according to FIG. 2. In particular, the grooves 11 and their openings 13 are dimensioned in such a way that the connecting element 1 can be pivoted around the axis 12 of the clamping flange 3, again by 15° on both sides of the center line 24. In regard to the specific design of the clamping flanges 2 and 3, the axis 12 is outside the clamping flange 3; its pivotability within the groove is, however, hereby ensured by the surfaces of the groove 11 on one hand and of the clamping flange 3 on the other hand, which are located on the shell of a circular cylinder and which correspond to one another.

The connecting element used in the wall element-column connection according to FIG. 2 is separately depicted in an enlarged perspective view. It can be inferred from this depiction that the two clamping flanges 2 and 3 each have a cavity 38 on their ends which tapers conically. This cavity 38 serves to accommodate an expanding element in the shape of a conically pointed thorn 39. When the wall elements 5 have been aligned with one another and the column 6, then the thorn 39 is pressed axially into the cavity 38, whereby the corresponding clamping flange 3 is expanded and is prestressed for fixed setting against the inner wall of the groove 11. A frictionally engaged connection is hereby produced between the connection profile 9 and the connecting element 1, leading to a fixing of the angle of the relevant wall element to the column 6.

Figure 3:
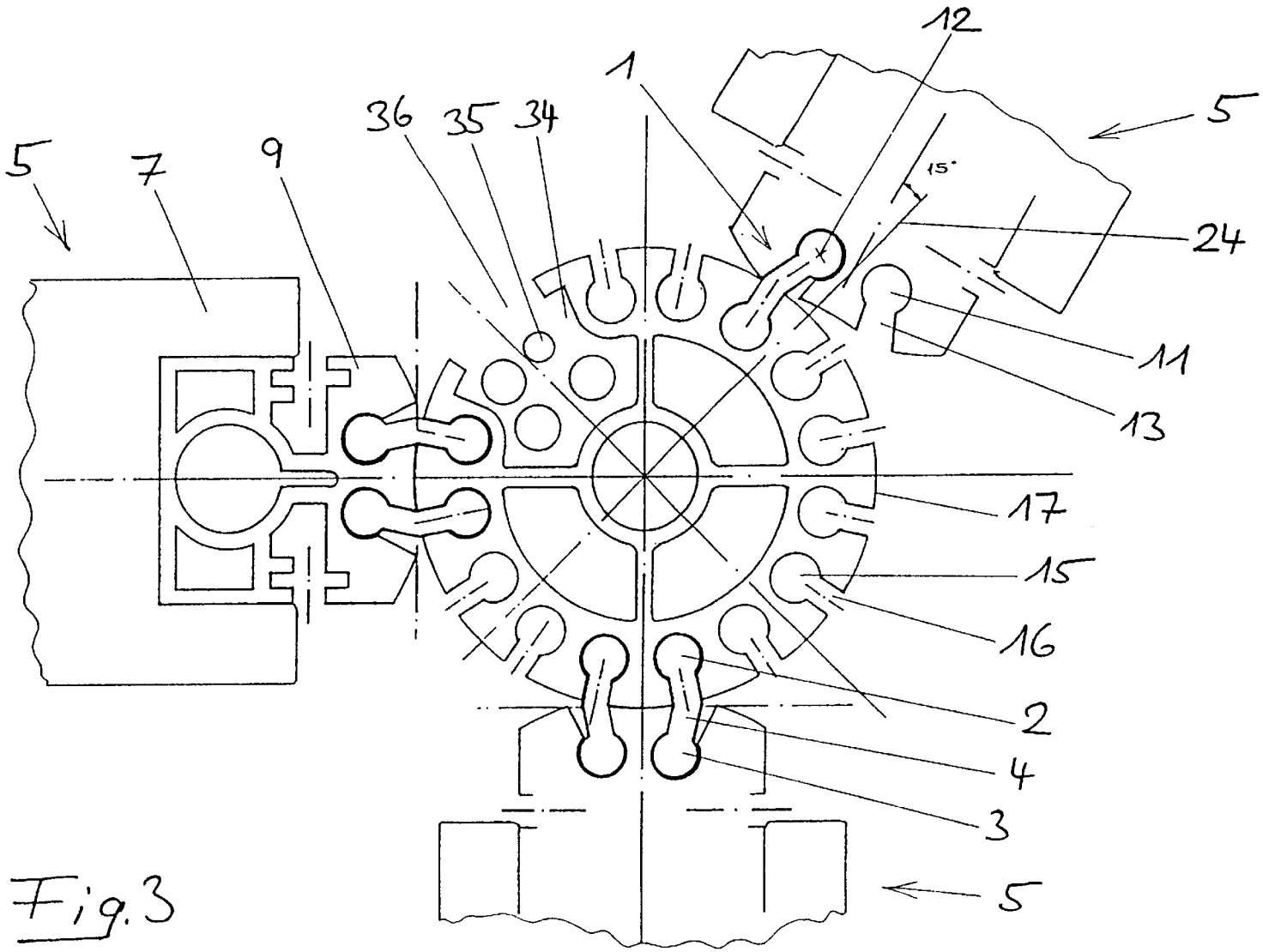

After the preceding explanations of FIGS. 1 and 2, the wall element-column connection illustrated in FIG. 3 almost explains itself. It should be emphasized that, according to FIG. 3, there is a possibility of producing a rigid connection between each wall element 5 and the column 6 by using two identically designed connecting elements 1. If, however, the wall elements 5 are connected with the column 6 via only one connecting element 1 (upper right), then the wall element 5 can be pivoted relative to the center line 24 by two times 15°. The development of the grooves 11, and the openings 13 of the connection profile 9 assigned to them, again controls pivotability in this case.

While symmetrical connecting elements are used according to each of the FIGS. 1 to 3 described in the preceding, the wall element-column connections according to FIGS. 4 to 9 described in the following each concern asymmetrical connecting elements.

Figure 4:
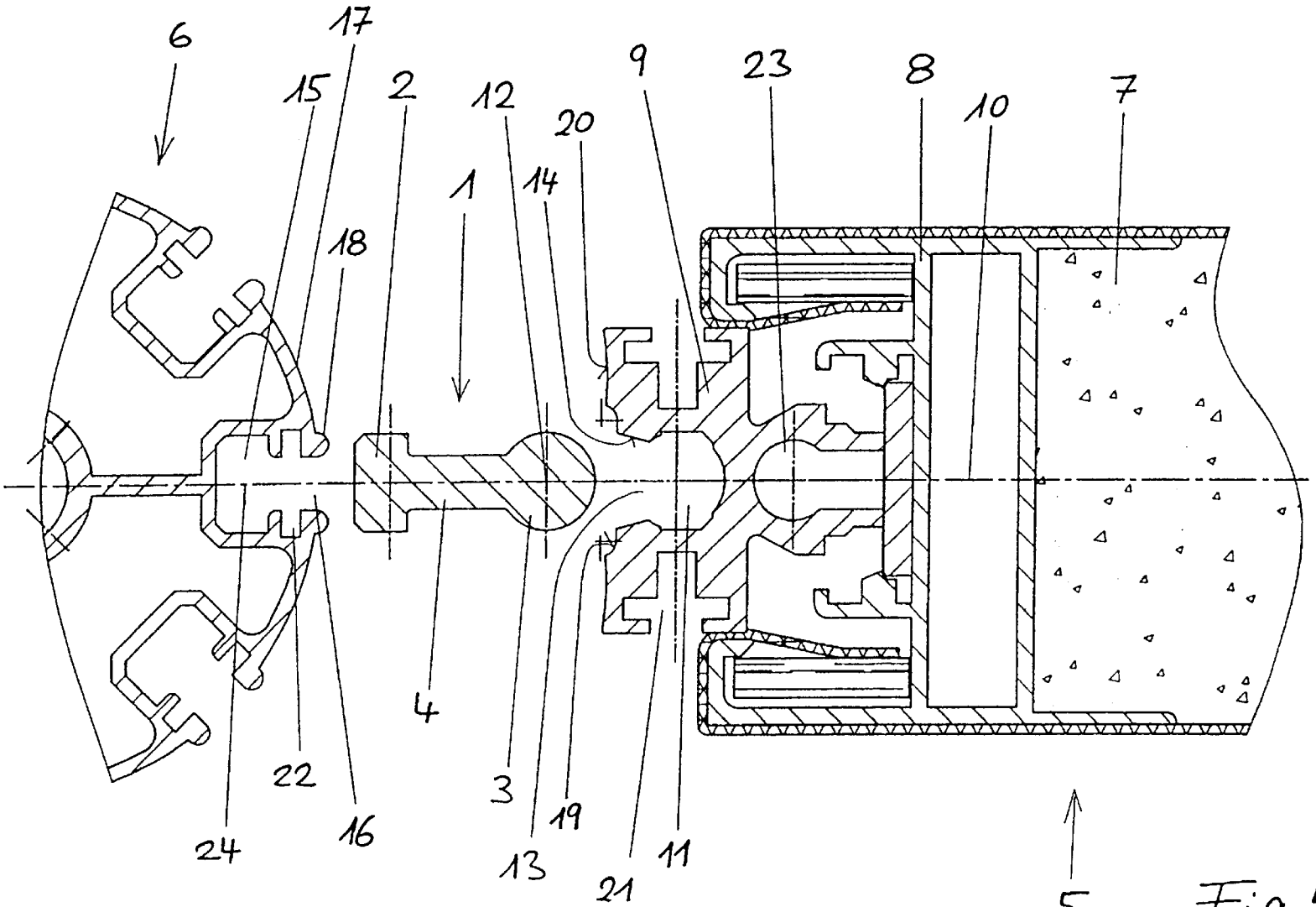
FIGS. 4 to 6 illustrates the connection of a wall element with the column using a first preferred embodiment of an asymmetrical connecting element.
Figure 5:
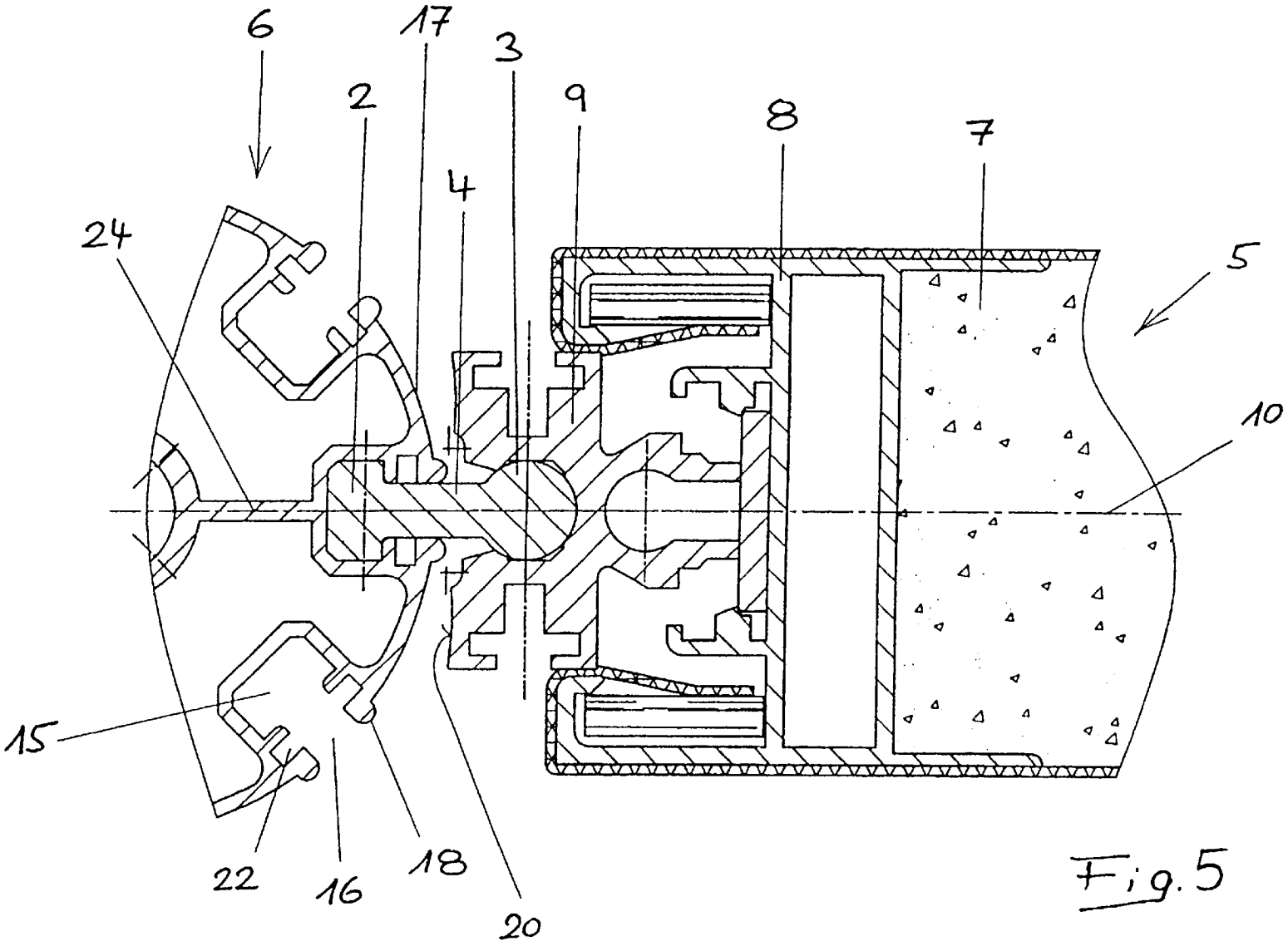
Figure 6:
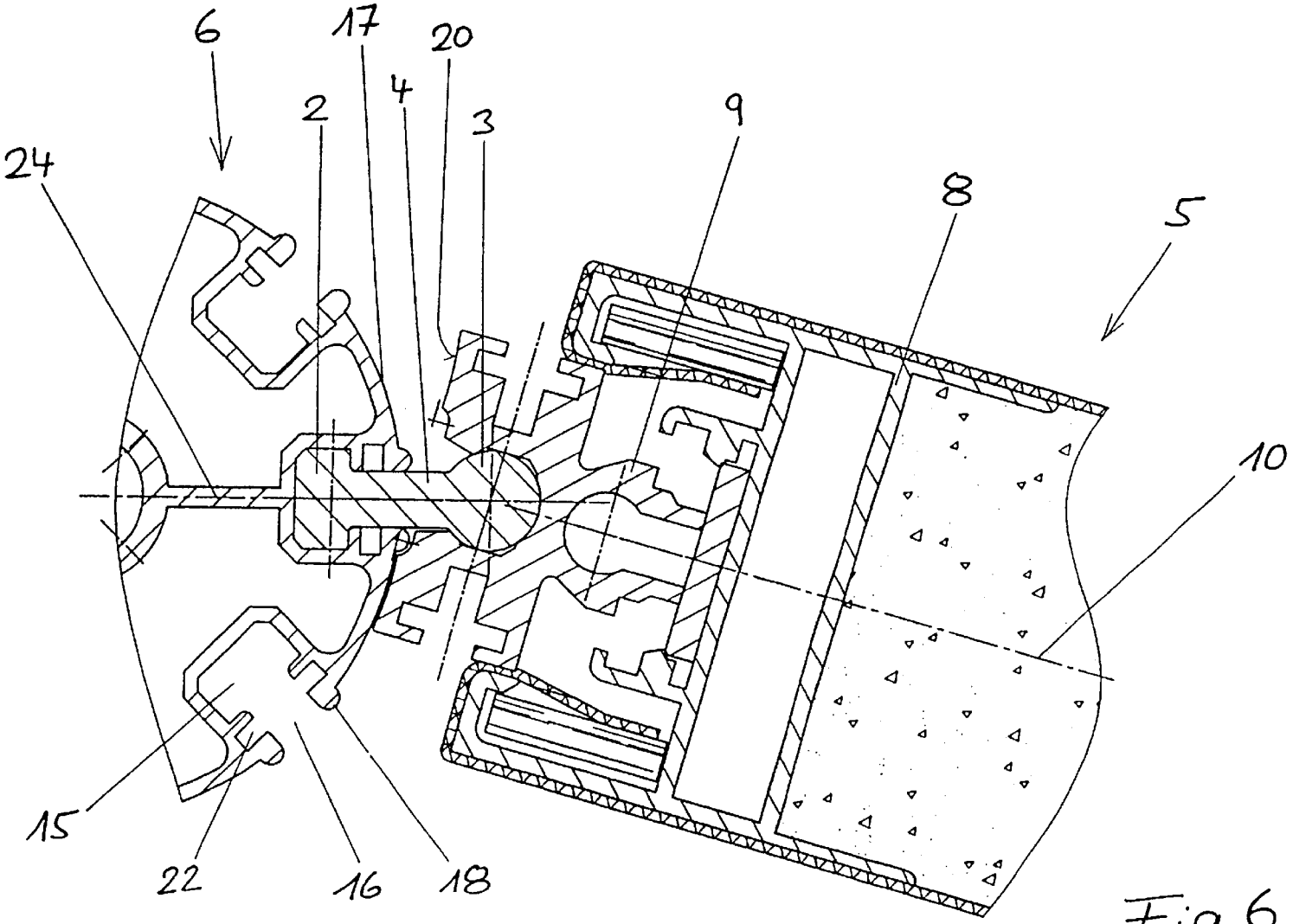

According to FIGS. 4 to 6, the connecting element 1 comprises a first clamping flange 2 and a second clamping flange 3 which are connected via a connecting link 4. The first clamping flange 2 is of a basically rectangular shape, with the two edges pointing outward flattened to form a hammer-shaped cross-section. The second clamping flange 3 has a circular cross-section. Using the connecting element 1, a wall element 5 and a column 6 of a partition wall can be connected with one another, as is illustrated in FIGS. 4 to 6. The wall element 5 hereby comprises a body 7, a frame profile 8 rigidly attached to it, and a connection profile 9 affixed to this. In a corresponding development of the wall body 7 and the connection profile 9, the connection profile 9 can, in the framework of the present invention, also, of course, be mounted directly on the wall body 7 while leaving out the frame profile. The design of the wall body 7 and the frame profile 8 is not important for the present invention; further explanation will therefore be dispensed with in this regard.

The connection profile 9 is essentially T-shaped. The development of the groove 11 located in the center plane 10 is significant in connection with the present invention. This groove is suitable for accommodation of both the first clamping flange 2 and the second clamping flange 3 of the connecting element 1. The contour of the groove 11 thereby results from the superposition of the contours of the two clamping flanges 2 and 3 of the connecting element 1. In this regard, the design and dimensioning of the two clamping flanges 2 and 3 of the connecting element 1 is chosen in such a way that, with the superposition described previously, the contour of the groove corresponds partially to the contour of the first non-round clamping flange 2 and partially to the contour of the second round clamping flange 3. The result of this is that the groove 11 is suitable for accommodation of both the first clamping flange 2 and the second clamping flange 3, with the second clamping flange 3 accommodated in the groove 11 so that it is rotatable around its axis 12 due to its round cross-section, while the first clamping flange, in contrast, is accommodated in the groove 11 in a non-rotatable, interlocking way. The connecting element 1, which has its second, round clamping flange 3 accommodated in the groove 11 of the connection profile 9, can hereby be pivoted around the axis 12. The pivoting range is hereby limited. It is predetermined by the clearance of the opening 13 of the groove 11, and is ±15° in the present case. The opening 13 of the groove 11 is hereby formed by slanted stop surfaces 14 which enclose an angle of 30° to one another.

FIG. 6 shows that the contour of the groove 15 of the column 6 is exactly tailored to the contour of the first clamping flange 2 of the connecting element 1. The groove 15 of the column 6 can thereby accommodate the first clamping flange 2 of the connecting element 1 in an interlocking, non-rotatable way. The clearance of the opening 16 of the groove 15 is only slightly larger than the thickness of the connecting link for of the connecting element 1.

The column 6 has outwardly projecting ribs 18 on its external surface 17 on both sides of the opening 16 of each groove 15. The connection profile 9 has recesses 19 neighboring the opening 13 of the groove 11 which correspond to these ribs. The function of the ribs 18 and the recesses 19 will be described in more detail below with reference to FIG. 3. This is also true for the concave curved bearing surfaces 20 of the connection profile 9.

The connection profile 9 additionally has two cross-shaped grooves 21 which are open laterally. These each particularly serve for accommodation of a perforated strip on which accessories can be attached to the relevant wall element 5. In a corresponding way, recesses 22, lying opposite to one another, are provided in the region of the grooves 15 of the column 6 which also serve to accommodate a perforated strip. Finally, the connection profile 9 has a multipurpose boring 23 available, which particularly serves for the attachment of a foot to the relevant wall element 5 and for accommodation of a connection bolt serving to attach a neighboring wall element.

FIG. 5 shows the unit made of a column 6, a wall element 5, and a connecting element 1 connecting these two components of a partition wall with one another. The first clamping flange 2 of the connecting element 1 is hereby accommodated in the groove 15 of the column 6 in an interlocking, non-rotatable way. In contrast, the connecting member 1 and the wall element 5 can be pivoted relative to one another around the axis 12 of the second clamping flange 3 accommodated in the groove 11 of the connection profile 9. The wall element 5 can thereby be pivoted out of the position shown in FIG. 5, in which the center line 10 of the wall element is aligned with the center line 24 of the groove 15 of the column 6, by 15° at a time.

FIG. 6 shows the situation for a wall element 5 pivoted into one of its two end positions. One of the concave bearing surfaces 20 of the connection profile 9 hereby presses against the curved external surface 17 of the column 6; and the neighboring rib 18 of the column 6 extends into the assigned recess 19 of the connection profile 9. One of the stop surfaces 14 also presses against the connecting link 4 of the connecting element 1. In this way, the angular range available for pivoting of the wall element 5 is limited by several interacting stops.

Figure 7:
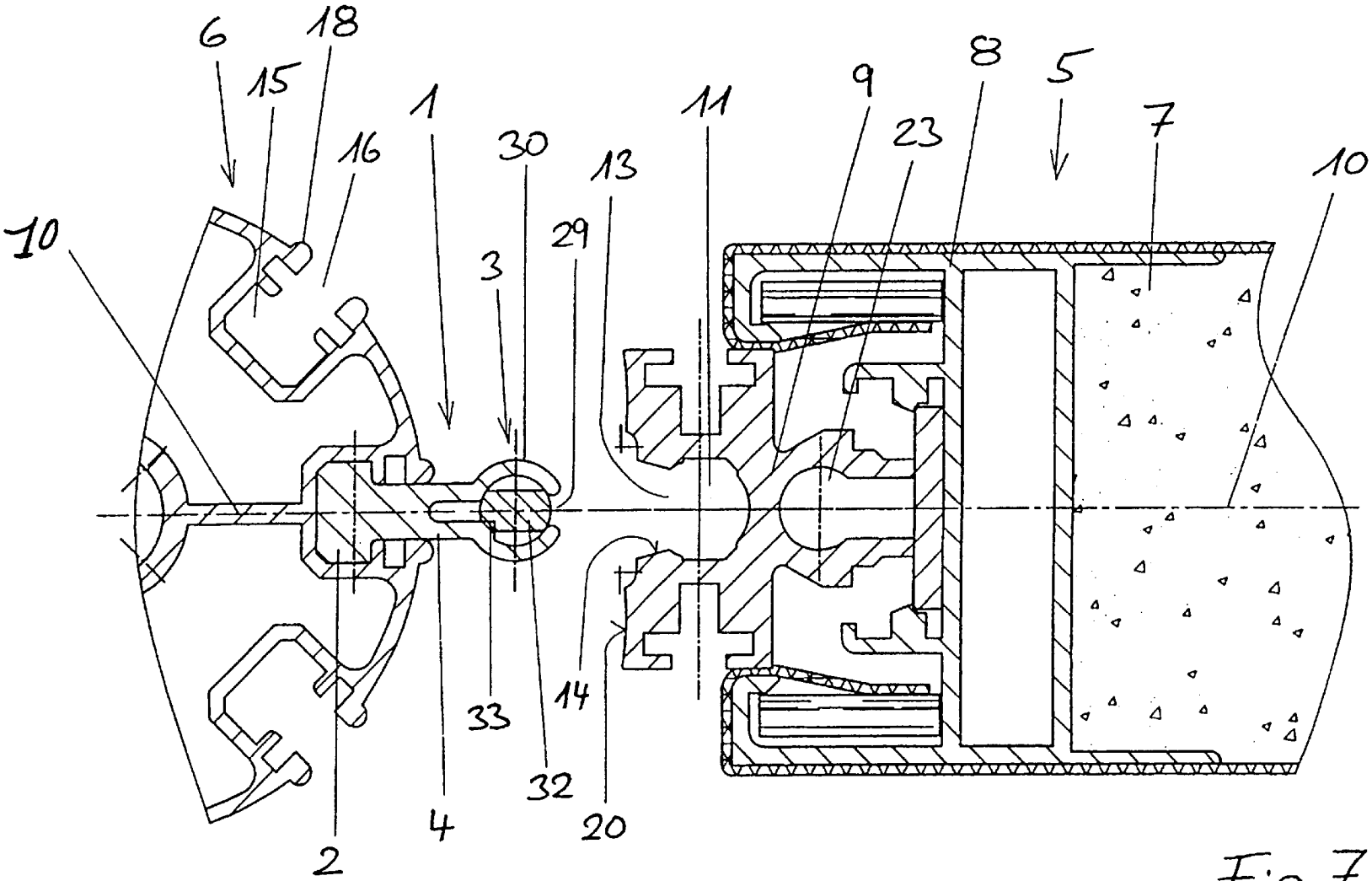
FIGS. 7 and 8 show the use of a second preferred embodiment of an asymmetrical connecting element for connection of a wall element with the column.
Figure 8:
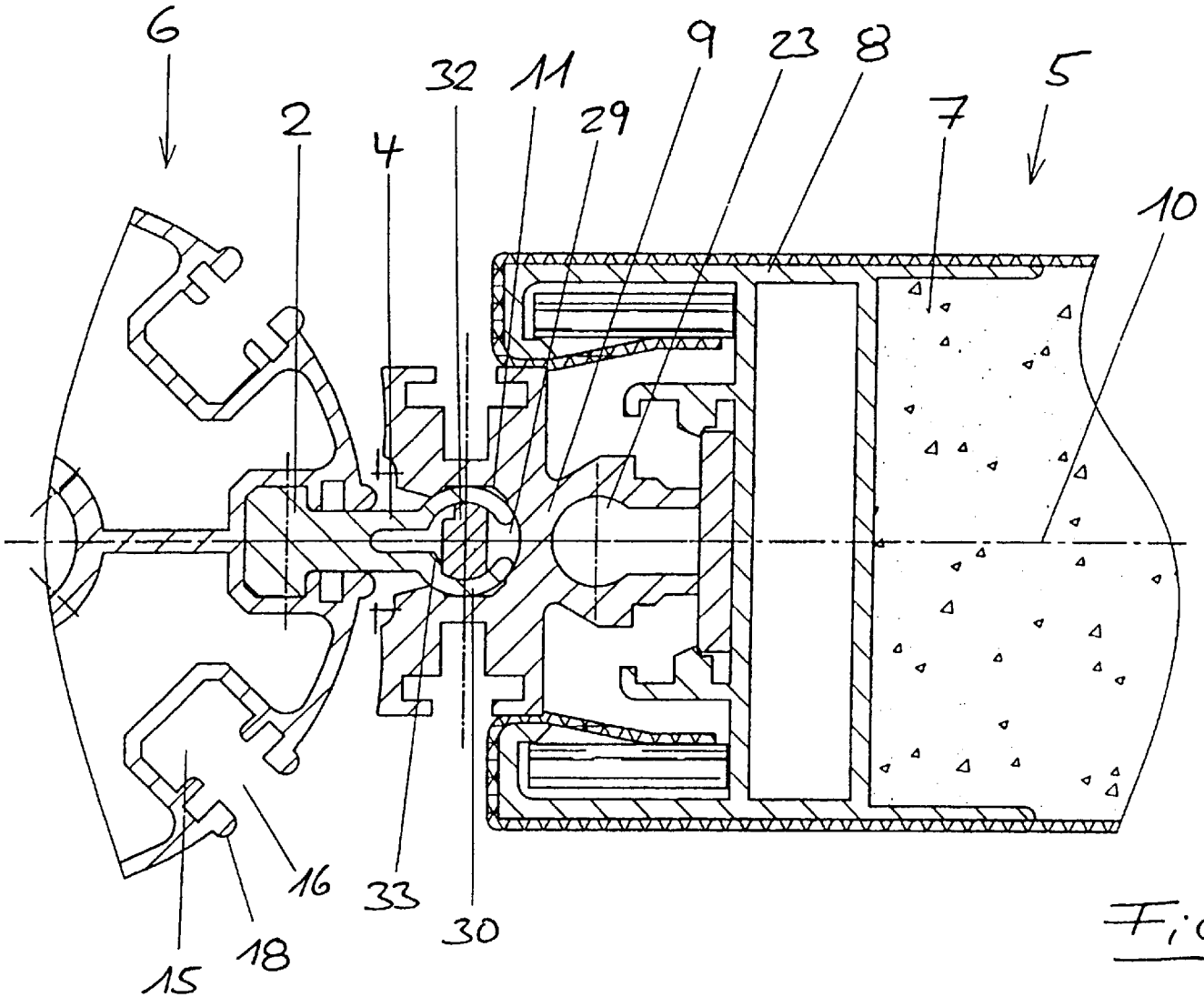

FIGS. 7 and 8 illustrate a modification of the connecting element described in the preceding with reference to FIGS. 4 to 6. In this case, the round clamping flange 3 is implemented as hollow and slotted. The round clamping flange 3 is hereby formed by two cheeks 30 enclosing a cavity 28, with the cavity 28 open externally through a gap 29 between the ends of the cheeks 30 lying opposite to one another. The cheeks 30 are implemented as springy. An expanding element implemented as a flattened toggle 32 is located between them in the cavity 28. The toggle 32 can be rotated around its longitudinal axis, with the rotatability limited to 90° by the stop 33. While the position of the toggle 32 shown in FIG. 7 can deflect the cheeks 30 so that the round clamping flange 2 can be inserted laterally through the opening 13 into the groove 11 in a flattened shape, in its position shown in FIG. 6, in which it is rotated by 90°, the toggle 32 prevents the cheeks 30 from being pressed together, so that a rigid connection results between the connecting element 1 and the connection profile 9. In this regard, the toggle 32 even expands the cheeks 30 for rigid, frictionally engaged contact against the inner wall of the groove 11, so that the angle of the wall element 5 to the column 6 is fixed. The connection illustrated in FIGS. 7 and 8 otherwise corresponds to the system described above according to FIGS. 4 to 6, so that no further explanations are needed here.

Figure 9:
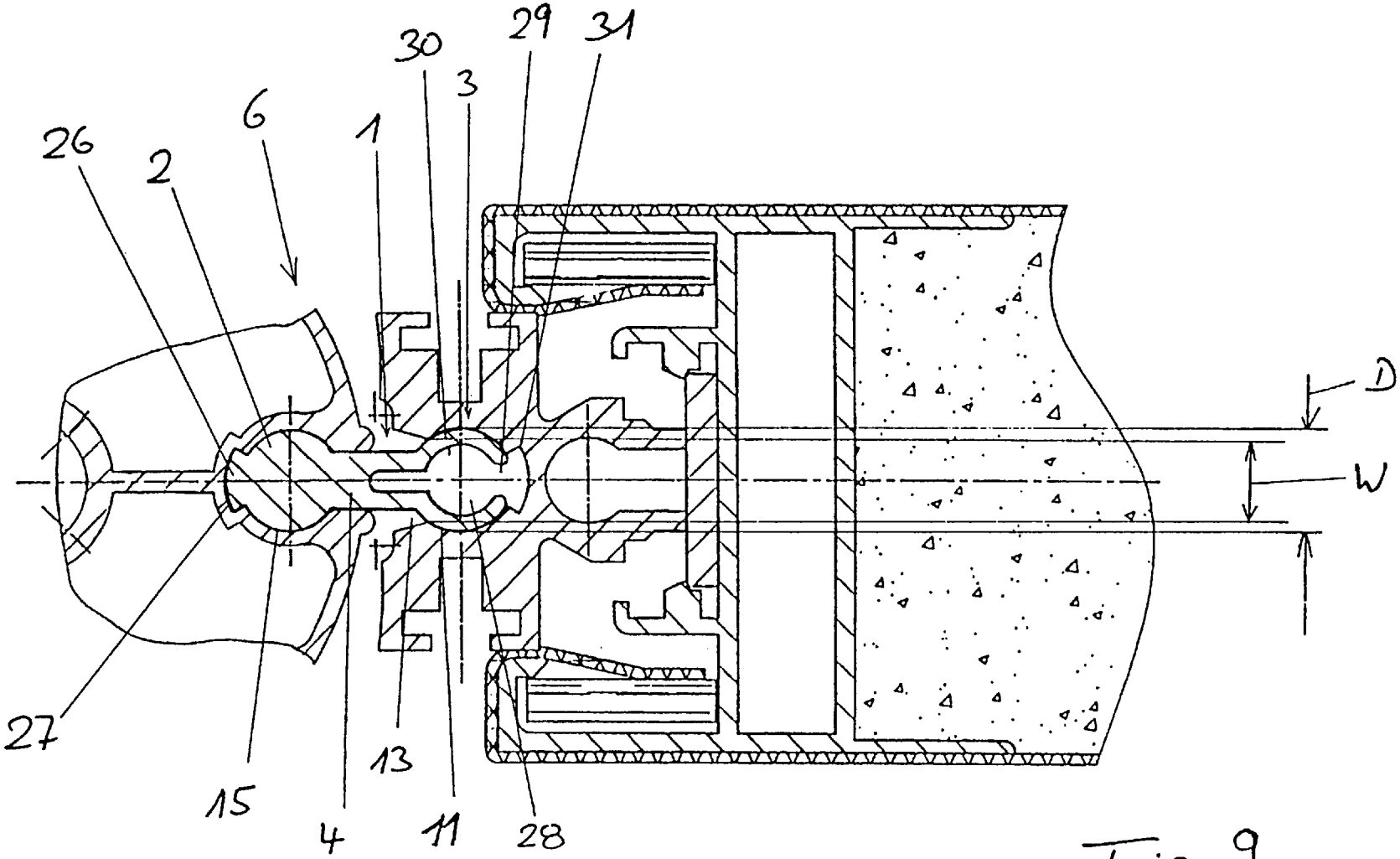
FIG. 9 illustrates the use of a third preferred embodiment of an asymmetrical connecting element for connection of a wall element with a column.

FIG. 9 illustrates the situation further described above with reference to FIGS. 4 to 6, again using a modified connecting element 1. According to FIG. 9, the first, "non-round" clamping flange 2 has an essentially round cross-section. However, it hereby has a laterally projecting rib 26 available. For non-rotatable, interlocking accommodation of this first clamping flange 2, the groove 15 of the column 6 has a corresponding recess 27 available; this extends over the same range of the circumference as the rib 26. The second, round clamping flange 3 has, in turn, a circularly cylindrical external surface, which ensures the pivotability of the connecting element 1 around the axis 12 of the second clamping flange 3 accommodated in the groove 11 of the edge profile 9. In this regard, the second clamping flange 3 has a cavity 28. Furthermore, it is slotted, so that the cavity 28 is open to the outside through a gap 29. As a result, the second clamping flange 3 is thereby reduced to two springy cheeks 30. The clearance of the gap 29 is hereby larger than the difference between the diameter D of the second, round clamping flange 3 and the clearance W of the opening 13 of the groove 11 of the connection profile 9. The springy cheeks 30 of the second clamping flange 3 can, in this way, be compressed to such a degree that the second clamping flange 3, which is pressed flat appropriately, can be inserted laterally through the opening 13 into the groove 11. When the second clamping flange 3 has entered completely into the groove 11, the cheeks 30 spring back into their initial position, in which they press against the inner wall of the groove 11. An expanding element (not shown) is then inserted into the cavity 28, which prestresses the springy cheeks 30 so they are firmly pressed against the inner wall of the groove 11. The groove 11 of the connection profile 9 has a recess 31 available whose shape corresponds to the recess 27 of the groove 15 of the column 6. This serves for accommodation of the rib 26 of the non-round clamping flange 2 of the connecting element 1 when two wall elements 5 are connected to one another.

What is claimed is:

1. Partition wall, comprising at least one wall element connected via a connecting element with a column, said column having a number of grooves distributed around its circumference which are suitable for interaction with the connecting element, wherein:

the wall element has a connection profile, having at least one groove around its periphery and adjacent to the column;

the connecting element has two parallel clamping flanges connected to one another via a connecting link, of which one of said flanges is accommodated in a groove of the column and the other is accommodated in a groove of the connection profile of the wall element;

one of the two clamping flanges of the connecting element is non-rotatably accommodated in the groove assigned; in which it is positioned;

wherein the other clamping is accommodated in the groove assigned so that it can be pivoted around its longitudinal axis within a predetermined angular range.

2. Partition wall according to claim 1, wherein the clamping flange is pivotable within a predetermined angular range in the assigned groove of the connection profile is allocated to the wall element.

3. Partition wall according to claim 1, wherein the clamping flange so that it can pivot is pivotable within a predetermined angular range in the assigned groove allocated to the column.

4. Partition wall according to claim 1, wherein the connecting element is symmetrically designed such that the two clamping flanges have an identical cross-section.

5. Partition wall according to claim 1, wherein the connecting element is asymmetrically designed in that the two clamping flanges have an differ from one another.

6. Partition wall according to claim 1, wherein at least one of the two clamping flanges has a cross-section which is at least partially circular.

7. Partition wall according to claim 1, wherein further comprising a locking a element, wherein the angle of the connecting element in the groove, in which the assigned clamping flange is rotatably accommodated, can be fixed.

8. Partition wall according to claim 7, at least one of the two clamping flanges is slotted and can be expanded by means of an expanding element.

9. Partition wall according to claim 8, wherein the expanding element is a rotatable toggle.

10. Partition wall according to claim 9, further comprising least one stop which limits the angular range within which the toggle is rotatable.

* * * * *